US009067649B2

(12) United States Patent
Humphreys

(10) Patent No.: US 9,067,649 B2
(45) Date of Patent: Jun. 30, 2015

(54) ICE BREAKING DRILLING VESSEL WITH STOWABLE MAST

(71) Applicant: Stena Drilling Ltd., Aberdeen (GB)

(72) Inventor: Gavin Humphreys, Aberdeen (GB)

(73) Assignee: Stena Drilling Ltd., Aberdeen (GB)

( * ) Notice: Subject to any disclaimer, the term of this patent is extended or adjusted under 35 U.S.C. 154(b) by 0 days.

(21) Appl. No.: 14/242,985

(22) Filed: Apr. 2, 2014

(65) Prior Publication Data

US 2014/0209004 A1 Jul. 31, 2014

Related U.S. Application Data

(62) Division of application No. 13/111,080, filed on May 19, 2011, now abandoned.

(51) Int. Cl.

| | |
|---|---|
| ***B63B 35/08*** | (2006.01) |
| ***B63B 35/44*** | (2006.01) |
| ***E21B 15/02*** | (2006.01) |
| ***E21B 15/00*** | (2006.01) |

(52) U.S. Cl.

CPC ..... *B63B 35/083* (2013.01); *E21B 15/02* (2013.01); *B63B 35/08* (2013.01); *B63B 35/4413* (2013.01); *E21B 15/00* (2013.01); *E21B 15/003* (2013.01)

(58) Field of Classification Search

CPC ..... B63B 35/08; B63B 35/083; B63B 35/44; B63B 35/4406; B63B 35/4413; E21B 7/023; E21B 15/00; E21B 15/003; E21B 15/02

USPC ..... 114/40, 41, 89–91, 258, 264

See application file for complete search history.

(56) References Cited

U.S. PATENT DOCUMENTS

| | | | | |
|---|---|---|---|---|
| 3,368,509 | A * | 2/1968 | Knight, Jr. et al. | 114/264 |
| 3,419,090 | A * | 12/1968 | Van Dorn | 175/7 |
| 3,749,162 | A * | 7/1973 | Anders | 166/354 |
| 3,851,770 | A * | 12/1974 | Jenkins et al. | 414/22.56 |
| 3,872,814 | A * | 3/1975 | Rodriguez | 114/40 |
| 3,886,882 | A * | 6/1975 | Thornburg et al. | 114/40 |
| 4,112,863 | A * | 9/1978 | Nelson | 114/264 |
| 4,605,132 | A * | 8/1986 | van Seumeren | 212/297 |
| 4,613,001 | A * | 9/1986 | Edberg et al. | 175/52 |
| 4,837,992 | A * | 6/1989 | Hashimoto | 52/118 |
| 4,932,175 | A * | 6/1990 | Donnally | 52/118 |
| 8,250,826 | B1 * | 8/2012 | Vogt | 52/651.05 |
| 2012/0291684 | A1 * | 11/2012 | Humphreys | 114/40 |

* cited by examiner

*Primary Examiner* — Ajay Vasudeva

(74) *Attorney, Agent, or Firm* — Trop, Pruner & Hu, P.C.

(57) ABSTRACT

A drilling vessel may function both as an ice breaker and, if needed, as a drilling platform for drilling a relief well. The vessel may be provided with a mast that may be stowed when drilling operations are not being conducted.

4 Claims, 2 Drawing Sheets

ICE BREAKING DRILLING VESSEL WITH STOWABLE MAST

CROSS-REFERENCE TO RELATED APPLICATIONS

This application is a divisional of U.S. patent application Ser. No. 13/111,080, filed on May 19, 2011.

BACKGROUND

This relates generally to drilling oil and gas wells in artic regions.

Oil and gas deposits have been located in regions which would be generally covered by ice throughout the year. In order to drill in such areas, a drilling ship must be led through the ice by an ice breaker. In addition, a second drilling ship maybe desirable on site in order to drill a relief well if a blowout or other failure occurs. Commonly, the second drilling ship maybe accompanied by its own separate ice breaker. Thus, a convoy of four ships may be needed.

Such a convoy is highly expensive since each of the drilling ships demands extremely high hourly rates and is very expensive to operate. Moreover, the second drilling ship may never even be needed and simply is on site in a standby mode in case of emergency.

DETAILED DESCRIPTION

In accordance with some embodiments of the present invention, a single drilling vessel may be capable of both ice breaking and drilling a relief well. This means that only two ships may be needed on site in an ice covered artic drilling regions such as Alaska and the Canadian Beaufort Sea through West and East Greenland to the Barents Sea and then on into the Russian seas. In some embodiments, substantial cost saving may result.

By the use of the term "drilling vessel", it is intended to refer to any vessel that is capable of drilling for oil or gas, including drilling ships with dynamic sufficient and capability, drilling platforms or any other floating device that is capable of drilling for a well for oil or gas.

In some embodiments, the drilling vessel has a stowable mast. The term "stowable mast" is intended to refer to any structure for use in supporting crown blocks and/or drillstrings from a drilling vessel, including a mast or a derrick to mention two examples. The term "stowable" is intended to refer to a mast that is positionable in at least two positions, one of which is a vertical operating position and the other is a position of reduced height, for example to enable ice breaking operations without unduly stressing the mast during ice collisions.

In some embodiments, the mast may be stowed during ice breaking or operations other than drilling. Thus, when the vessel is used for breaking ice, the high moment arm caused by the crown block and extended drilling mast may not be applied to the drilling vessel. As a result, the drilling vessel may be manufactured more economically for lower stress. Moreover, the vessel may be quicker and more maneuverable with the mast in the stowed position. Then, if drilling operations are necessary, the mast may be raised and drilling may be conducted.

Figure 1:
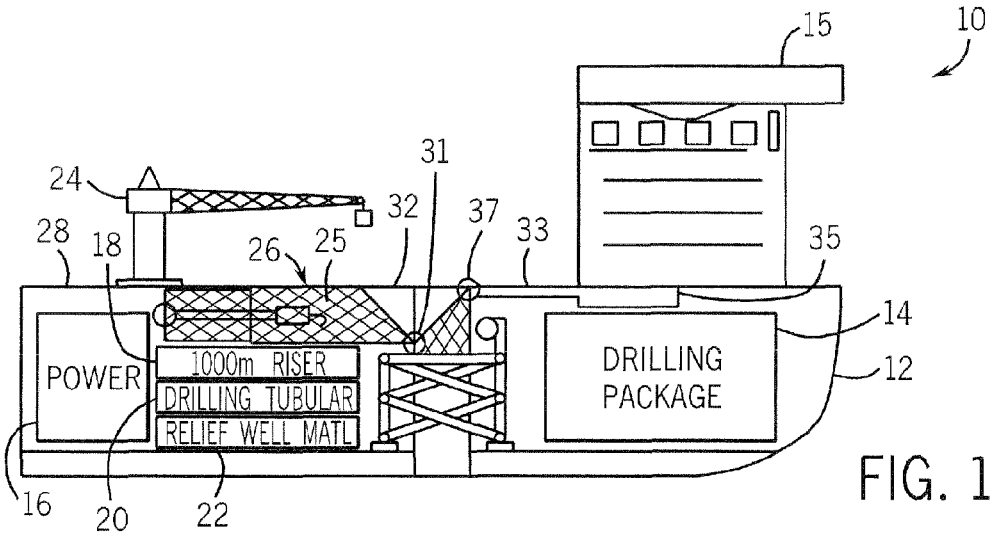
FIG. 1 is a partial cross-section view of the first embodiment in the present invention with the mast in the stowed position.

Referring to FIG. 1 an ice breaking drilling vessel 10 may have an ice breaking hull 12. An ice breaking hull 12 is basically a reinforced hull for purposes of breaking ice. A power system 16 may be a suitable power to power the ship and to provide sufficient motive force to break ice as the ship progresses through an ice field.

Within the hull 12 are basic drilling accessories including a drilling package 14, a 1000 meters of riser 18 in one embodiment, drilling tubulars 20, and relief well material 22. The drilling package may include items such as a blowout preventer and the relief well materials may include things such as a well head and casing required for a relief well.

The deck 28 may be punctuated by a crane 24. A stowable mast 26 may be recessed below deck within the hull such that its upper surface, when stowed, is substantially co-planar with the deck surface 28. It may be covered in some embodiments with the deck material such that the deck is fully usable with the mast 26 in the stowed position shown in FIG. 1.

A hinge 31 secures the pivoting part 25 of the mast 26 to a stationary part 32. The bottom surface of the pivoting part 26 may be angled as may be the upper surface of the non-pivoting part 32. Thus, when the pivoting part 25 rotates 90 degrees clockwise to the position shown in FIG. 2, the angled surfaces of pivoting and non-pivoting parts abut and latch 37 may secure the pivoting part 25 to the non-pivoting part 32. A crown block 34 may be provided within the mast 26 in some embodiments.

The pivoting part 25, may itself include two telescoping sections 36 and 38. The section 36 can be telescoped out of the section 38 as indicated by arrow B.

The source of pivoting force applied to the mast 26 may in one embodiment be a reciprocating hydraulic cylinder 35 with a bar 33 that connects to the moveable portion. When the bar 33 is pulled forward the mast may be erected. In some embodiments, the bar 33 and the hydraulic cylinder 35 may be recessed within the deck.

In some embodiments, a hinged cover (not shown) may be provided over the stowed mast 26 and the hydraulic cylinder 35 and bar 33. This hinged cover may pivot away when the mast is raised. Once the mast is raised, the hinged cover can be closed back to provide usable deck space and to cover the empty storage slot 40 for the stowable mast. As a result, the deck is substantially entirely usable whether the mast is stowed or in use.

A pilot house 15 may be formed on the deck 28 in some embodiments.

Suitable means for righting the stowed mast 26 are varied and may include hydraulic cylinders, cable systems, and rack and pinion systems. In the embodiment shown in FIGS. 1 and 2, a hydraulic cylinder mounted in the deck pulls the mast upright without consuming significant or, in some cases, any surface of the deck. To this end, the bar 33 may be embedded within the deck, operable within appropriate deck slots.

Figure 2:
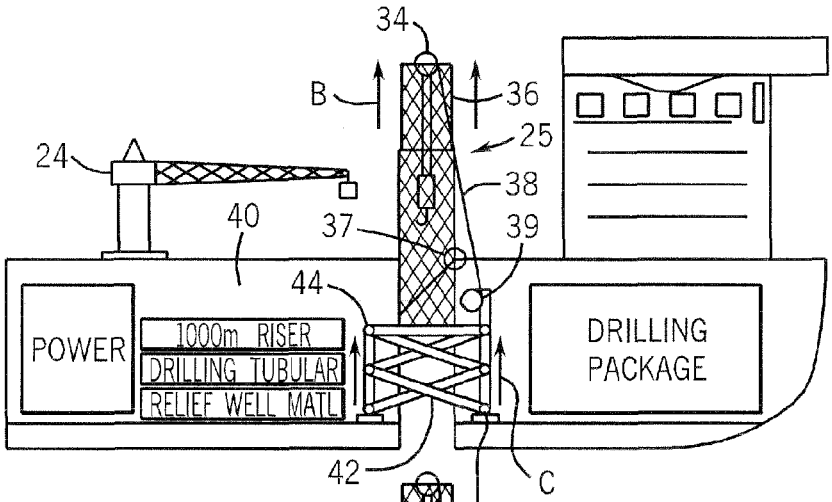
FIG. 2 is a partial cross-section view corresponding to FIG. 1 with the mast partially erected.

Once upright, in the position shown in FIG. 2, a portion 36 of the mast 26 may be telescopically extended relative to the portion 38 to provide even greater mast height. The motive means for doing so may include any of the righting means described above.

Figure 3:
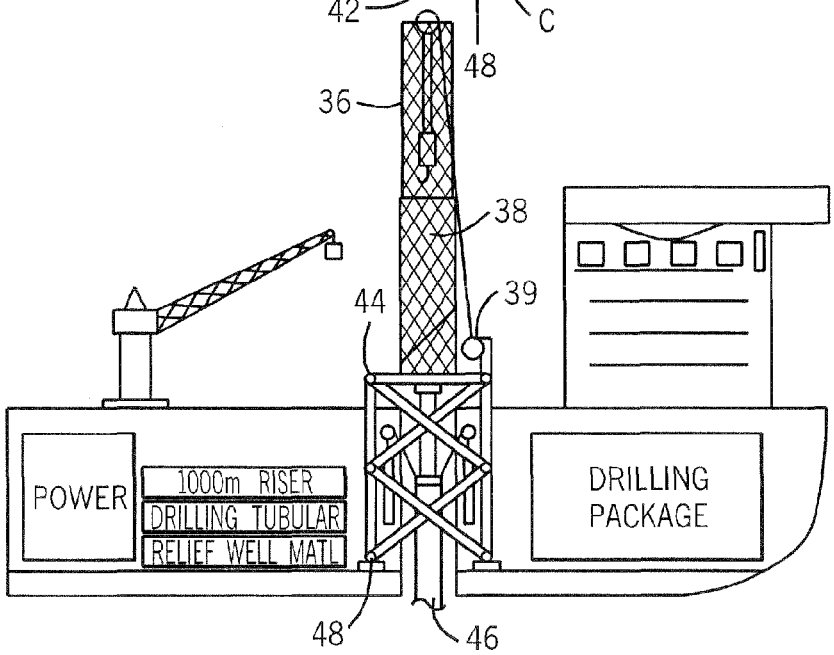
FIG. 3 is a partial cross-section view corresponding to FIG. 2 with the mast fully erected.

Furthermore, as shown in FIG. 3, after the portion 36 has been extended (or while it is being extended) the platform 44 may be extended. In one embodiment, the platform 44 may be a scissors mechanism 42 that may be raised using operators 48. The operators 48 may be any of the reciprocating righting means described above.

Once the mast is fully extended to the position shown in FIG. 3, drillstring 46 may be attached to the mast and drilling operations may be conducted. The crown block may be raised and lowered using the winch 39 in some embodiments. Any of the equipment stored within the hull including the drilling package, the risers or tubulars or the relief well material may be accessed using the crane 24 or other means well known to those skilled in the art. Once the drilling operations are completed, the mast may be lowered into the deck and folded back into position shown in FIG. 1.

In some embodiments, advantageously, only one drilling vessel and an ice breaker combined drilling vessel may be needed on site in the remote artic areas covered with ice. The ice breaker may function to break ice for the accompanying drilling vessel and, if needed, may be also capable of drilling a relief well. Because the mast may be collapsed or stowed, the ship may effectively function as an ice breaker in that the mast may not be subject to extreme loading during ice breaking operations. Moreover, the ice breaker may proceed with greater speed in some embodiments without the upright mast in place.

In some embodiments, only the minimum amount of drilling equipment may be provided, sufficient to drill only a relief well. For example, only a 1000 meters of riser may be carried in one embodiment. Reducing the drilling equipment reduces the overall vessel weight.

Figure 4:
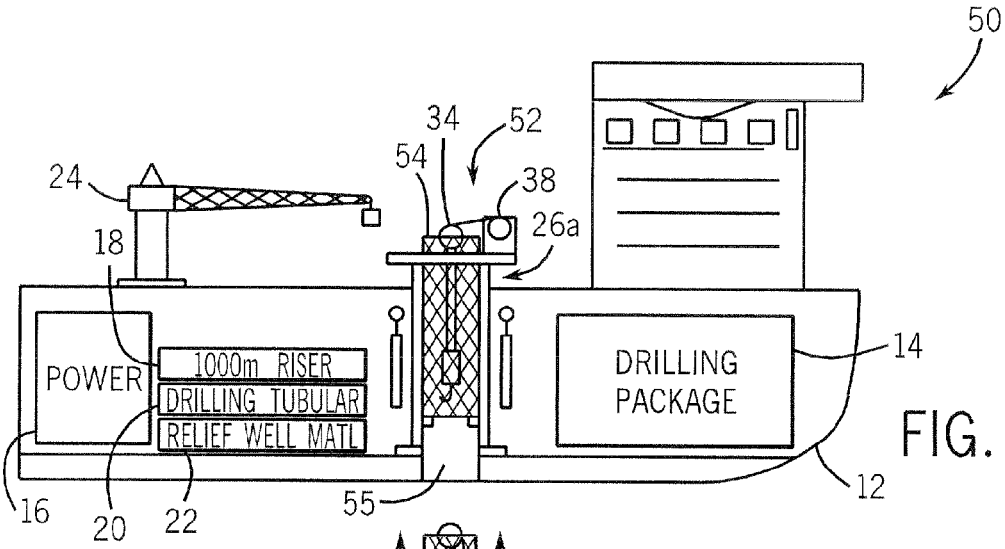
FIG. 4 is a partial cross-section view of another embodiment of the present invention with the mast stowed.
Figure 5:
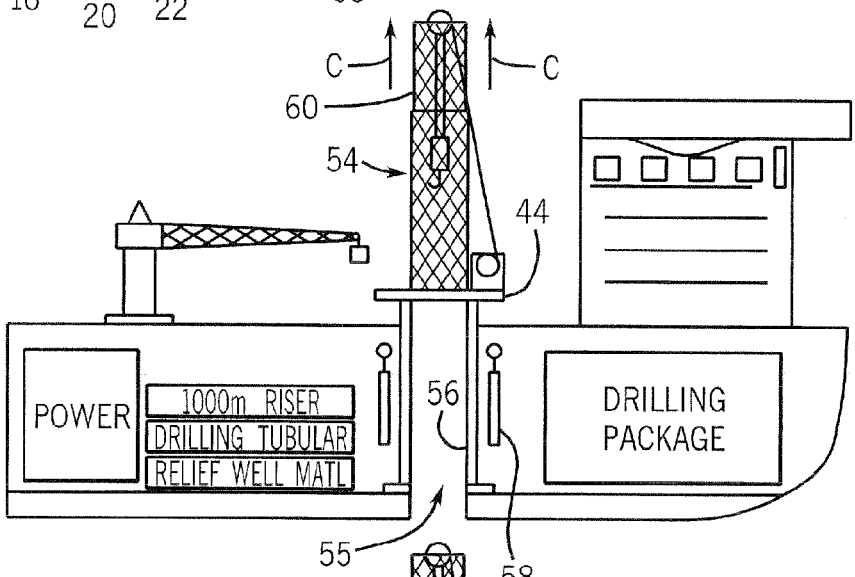
FIG. 5 is a partial cross-section view corresponding to the embodiment of FIG. 4 with the mast partially erected.

In accordance with another embodiment of the present invention shown in FIG. 4, instead of using a pivoting mast, the mast 26*a* in the drilling vessel 50 is simply vertically telescoping in one or more stages. In the stage shown in FIG. 4, the mast is fully retracted into the storage area 55 below deck. In FIG. 5, the mast is fully extended out of the storage area 55 with the telescoping section 54 extending completely above the deck. This extension may be powered by hydraulic lifters 56 for example. The telescoping section 60 further telescopically extends upwardly from the rest of the section 54 as indicated by arrow C. Then as shown in FIG. 6, drilling operations may be conducted using the drillstring 46.

Figure 6:
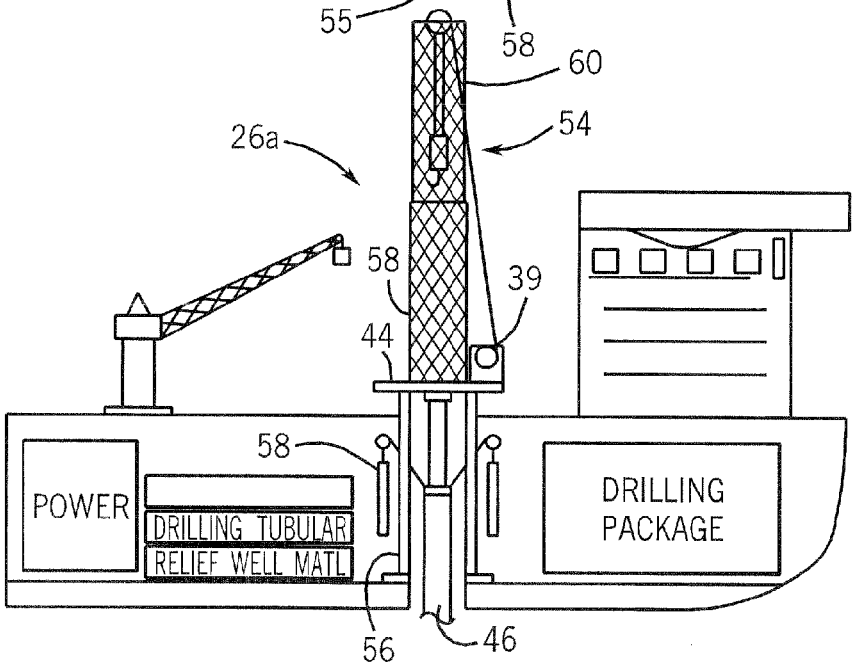
FIG. 6 is a partial cross-section view corresponding to FIG. 5 with the mast fully erected.

In some embodiments, the arrangement shown in FIGS. 4-6 may be less efficient in deck space usage because some deck space must be dedicated to the drilling operations (whether needed or not). That is, the crown block 34 and telescopic mast 26*a* basically consume deck space that cannot be used for other operations normally conducted by ice breakers.

Other arrangements may be also considered. For example instead of collapsing the mast to a position in alignment with the deck, the mast may be folded 180 degrees so that it extends vertically into the hull. When raised to the intermediate position (corresponding to FIG. 2), it could be unfolded to effectively double its height. Other arrangements will also envisaged by those skilled in the art.

References throughout this specification to "one embodiment" or "an embodiment" mean that a particular feature, structure, or characteristic described in connection with the embodiment is included in at least one implementation encompassed within the present invention. Thus, appearances of the phrase "one embodiment" or "in an embodiment" are not necessarily referring to the same embodiment. Furthermore, the particular features, structures, or characteristics may be instituted in other suitable forms other than the particular embodiment illustrated and all such forms may be encompassed within the claims of the present application.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A drilling ship comprising:

a hull;

a well formed in said hull;

a deck over said hull and said well;

a storage recess in said deck; and a telescoping drilling mast including a first telescoping drilling mast portion and a second telescoping drilling mast portion, said telescoping drilling mast including a support connected to said second drilling mast portion and to said ship so as to pass within said well, said support including a base connectable to said second telescoping drilling mast portion and a mechanism to move said base upwardly and downwardly relative to the ship's hull, said second mast portion having a pivot to allow said first drilling mast portion and at least part of said second drilling mast portion to pivot into said recess in said deck in a stowed position and to pivot upwardly to a working position above the ship's deck, such that said first and second drilling mast portions adapted to be stowed at least partially in said recess and said first and second drilling mast portions being reciprocable relative to each other and being reciprocally mounted on said support for upward motion relative to the deck of the ship.

2. The drilling ship of claim 1 wherein said hull is an ice breaking hull.

3. The drilling ship of claim 1 wherein said ship is an ice breaking and standby relief well drilling vessel.

4. The drilling ship of claim 1 wherein the mast is stowed entirely below said deck.

* * * * *